US010234147B2

(12) United States Patent
Yokozeki et al.

(10) Patent No.: US 10,234,147 B2
(45) Date of Patent: Mar. 19, 2019

(54) AIR CONDITIONER

(71) Applicant: Hitachi-Johnson Controls Air Conditioning, Inc., Minato-ku, Tokyo (JP)

(72) Inventors: Atsuhiko Yokozeki, Tokyo (JP); Susumu Nakayama, Tokyo (JP); Hiroaki Tsuboe, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 202 days.

(21) Appl. No.: 14/422,224

(22) PCT Filed: Sep. 30, 2013

(86) PCT No.: PCT/JP2013/076465
§ 371 (c)(1),
(2) Date: Feb. 18, 2015

(87) PCT Pub. No.: WO2014/061431
PCT Pub. Date: Apr. 24, 2014

(65) Prior Publication Data

US 2015/0198341 A1 Jul. 16, 2015

(30) Foreign Application Priority Data

Oct. 15, 2012 (JP) ..... 2012-227664

(51) Int. Cl.
*F24F 11/00* (2018.01)
*F24F 3/10* (2006.01)
(Continued)

(52) U.S. Cl.
CPC ..... *F24F 3/10* (2013.01); *F24F 11/30* (2018.01); *F24F 11/83* (2018.01); *F25B 41/062* (2013.01);
(Continued)

(58) Field of Classification Search
CPC ..... F24F 3/10; F24F 11/0012; F24F 11/008; F25B 41/062; F25B 2313/0314;
(Continued)

(56) References Cited

U.S. PATENT DOCUMENTS 5,709,090 A * 1/1998 Endo ..... F25B 9/006 62/174
6,244,057 B1 * 6/2001 Yoshida ..... F25B 13/00 62/151
(Continued)

FOREIGN PATENT DOCUMENTS

DE 102006050763 A1 * 4/2008 ..... B60H 1/3205
JP 2-133760 A 5/1990
(Continued)

OTHER PUBLICATIONS

International Search Report (PCT/ISA/210) dated Dec. 17, 2013, with English translation (Five (5) pages).

*Primary Examiner* — Keith Raymond
*Assistant Examiner* — Nael Babaa
(74) *Attorney, Agent, or Firm* — Crowell & Moring LLP

(57) ABSTRACT

It is an object to obtain an air conditioner capable of suppressing rise of compressor discharge temperature and individually controlling cooling capacity of a plurality of respective indoor units. For this purpose, the air conditioner is a multi-room air conditioner, in which a refrigeration cycle is formed by connecting an outdoor unit 100 having an outdoor heat exchanger to the plurality of indoor units 200 and 300 having indoor heat exchangers 201 and 301 and indoor expansion mechanisms 203 and 303 using a liquid pipe 121 and a gas pipe 122. Further, as refrigerant circulating through the refrigeration cycle, R32 or mixed refrigerant containing 70 mass % or higher percent of R32 is used. Further, a temperature difference detection device to detect an air temperature difference between inlet-side air and
(Continued)

outlet-side air in the respective indoor heat exchangers of the respective indoor units is provided. The cooling capacity in the respective indoor units is controlled by regulating the indoor expansion mechanisms of the respective indoor units based on the air temperature difference in the indoor units detected with the temperature difference detection device.

4 Claims, 3 Drawing Sheets

(51) Int. Cl.

| | |
|---|---|
| ***F25B 49/02*** | (2006.01) |
| ***F25B 41/06*** | (2006.01) |
| ***F24F 11/30*** | (2018.01) |
| ***F24F 11/83*** | (2018.01) |
| *F25B 13/00* | (2006.01) |
| *F24F 110/10* | (2018.01) |
| *F24F 110/12* | (2018.01) |
| *F24F 11/84* | (2018.01) |

(52) U.S. Cl.
CPC ..... *F25B 49/02* (2013.01); *F24F 11/84* (2018.01); *F24F 2110/10* (2018.01); *F24F 2110/12* (2018.01); *F25B 13/00* (2013.01); *F25B 2313/0233* (2013.01); *F25B 2313/0314* (2013.01); *F25B 2600/2513* (2013.01); *F25B 2700/21152* (2013.01)

(58) Field of Classification Search
CPC .. F25B 2700/21171; F25B 2700/21172; F25B 2700/21173; F25B 2600/2513; F25B 2313/023
USPC ..... 62/200
See application file for complete search history.

(56) References Cited

U.S. PATENT DOCUMENTS

| | | | | |
|---|---|---|---|---|
| 6,581,397 | B1 * | 6/2003 | Taira | F25B 9/002 62/199 |
| 2010/0198416 | A1 * | 8/2010 | Kasahara | F25B 13/00 700/282 |
| 2013/0118197 | A1 * | 5/2013 | Kibo | F25B 1/00 62/222 |

FOREIGN PATENT DOCUMENTS

| | | | |
|---|---|---|---|
| JP | 6-294551 | A | 10/1994 |
| JP | 9-178284 | A | 7/1997 |
| JP | 2002-327950 | A | 11/2002 |
| JP | 2006-46692 | A | 2/2006 |
| JP | 3956589 | B2 | 8/2007 |
| JP | 2008-116124 | A | 5/2008 |

* cited by examiner

AIR CONDITIONER

TECHNICAL FIELD

The present invention relates to a multi-room air conditioner having a plurality of indoor units, and more particularly, it is preferably applicable to an air conditioner using R32 as refrigerant.

BACKGROUND ART

As a multi-room air conditioner having the plurality of indoor units, an air conditioner described in Japanese Patent Application Laid-Open No. Hei 2-133760 (Patent Literature 1) is known. In the air conditioner in this Patent Literature 1, it is described that upon cooling operation of the multi-room air conditioner, the cooling capacity of each of the plurality of indoor units is controlled using refrigerant superheat degree at the outlet of the heat exchanger in the each indoor unit.

Further, Japanese Patent No. 3956589 (Patent Literature 2) is known. In the device in this Patent Literature 2, it is presumed that as refrigerant, R32 which is HFC refrigerant with low global warming potential (GWP) is used. By using this R32, the discharge temperature of a compressor is 10 to 15° C. higher than that of R410A which is conventionally used refrigerant. To suppress rise of the discharge temperature, the vapour quality of the refrigerant at an inlet of the compressor is set to be equal to or higher than 0.65 and equal to or lower than 0.85.

CITATION LIST

Patent Literature

PTL 1: Japanese Patent Application Laid-Open No. Hei 2-133760

PTL 2: Japanese Patent No. 3956589

SUMMARY OF THE INVENTION

Technical Problem

As described in the above Patent Literature 1, upon cooling operation in a conventional multi-room air conditioner having a plurality of indoor units, the cooling capacity of the respective indoor units is controlled by regulating the flow rate of refrigerant flowing through the respective indoor units by controlling the refrigerant superheat degree at the outlet of the heat exchanger in the respective indoor units. However, when this refrigerant superheat degree control is performed, the refrigerant at the outlet of the heat exchanger in the indoor unit does not contain liquid refrigerant. Accordingly, the problem is that when refrigerant such as R32 is used, the compressor discharge temperature abnormally rises, and the reliability is lowered.

On the other hand, in the device described in the above Patent Literature 2, as the refrigerant R32 is used, the temperature of the refrigerant at the outlet of the compressor is 10 to 15° C. higher in comparison with R410A which is conventionally used refrigerant. Accordingly, the vapour quality of the refrigerant on the compressor inlet side is controlled to be smaller than that in the case where R410A is used. To reduce the vapour quality of the refrigerant on the compressor inlet side, the superheat degree of the refrigerant at the outlet of the heat exchanger should be 0 and the refrigerant should contain liquid refrigerant.

However, when the refrigerant at the outlet of the heat exchanger in the indoor unit contains liquid refrigerant, it is impossible to perform the refrigerant superheat degree control as described in the above Patent Literature 1. When only one indoor unit is used as in the case of the Patent Literature 2, it is possible to control its cooling capacity by controlling the evaporation temperature, i.e., the compressor inlet pressure. However, it is difficult to individually control the cooling capacity of the respective indoor units in the multi-room air conditioner.

The object of the present invention is to obtain an air conditioner capable of suppressing rise of compressor discharge temperature and individually controlling the cooling capacity of each of a plurality of indoor units.

Solution to Problem

To solve the above-described problem, the present invention provides a multi-room air conditioner in which a refrigeration cycle is formed by connecting an outdoor unit having an outdoor heat exchanger to a plurality of indoor units having an indoor heat exchanger and an indoor expansion mechanism using a liquid pipe and a gas pipe. As refrigerant circulating through the refrigeration cycle, R32 or mixed refrigerant containing 70 mass % or higher percent of R32 is used. The air conditioner comprises a temperature difference detection device that detects an air temperature difference between inlet-side air and outlet-side air in respective indoor heat exchangers of the respective indoor units. The cooling capacity in the respective indoor units is controlled by regulating the indoor expansion mechanism in each respective indoor unit based on the air temperature difference in the indoor unit detected with the temperature difference detection device.

Advantageous Effects of the Invention

According to the present invention, it is possible to obtain an air conditioner capable of suppressing rise of compressor discharge temperature, and capable of individually controlling the cooling capacity of the respective indoor units.

DESCRIPTION OF THE EMBODIMENTS

Figure 1:
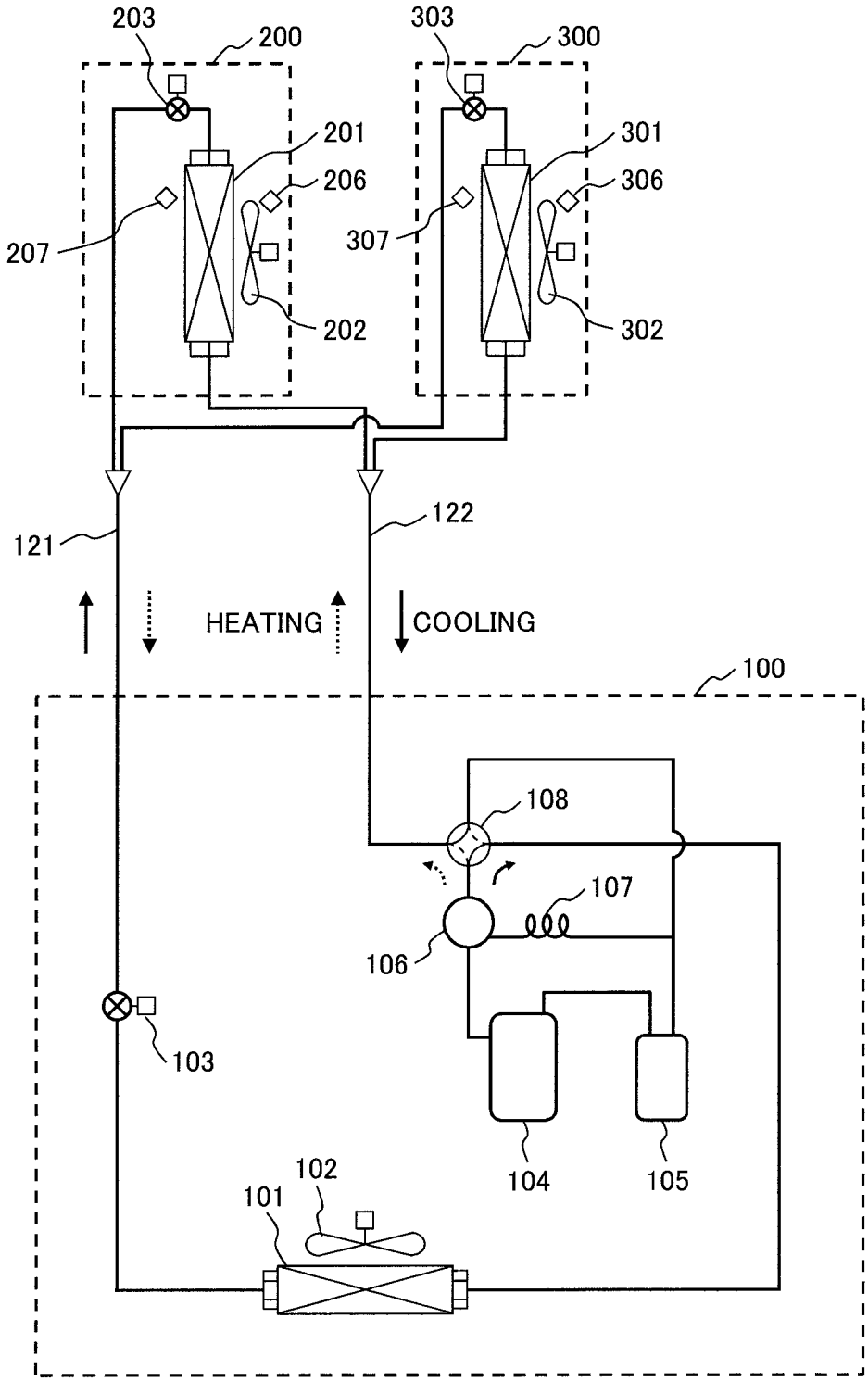
FIG. 1 is a block diagram of a refrigeration cycle showing an embodiment 1 of an air conditioner according to the present invention.

Hereinbelow, particular embodiments of an air conditioner according to the present invention will be described using the drawings. In the respective drawings, constituent elements having the same reference numerals are identical or corresponding elements.

Embodiment 1

An embodiment 1 of the air conditioner according to the present invention will be described in accordance with FIG. 1. FIG. 1 is a block diagram of a refrigeration cycle showing the present embodiment 1.

In FIG. 1, reference numeral 100 denotes an outdoor unit forming the air conditioner; and 200 and 300, indoor units respectively connected to the outdoor unit 100 with a liquid pipe 121 and a gas pipe 122. As shown in this figure, in the air conditioner according to the present embodiment, a refrigeration cycle is formed as a multi-room air conditioner in which the plurality of indoor units 200 and 300 are connected to the one outdoor unit 100. In the present embodiment, as refrigerant circulating through the refrigeration cycle, R32 or mixed refrigerant containing 70 mass % or higher percent of R32 is used.

The outdoor unit 100 has an outdoor heat exchanger 101, an outdoor fan 102, an outdoor expansion valve 103, a compressor 104, an accumulator 105, an oil separator 106, an oil return capillary 107, a four-way valve 108, and the like.

The indoor units 200 and 300 respectively have indoor heat exchangers 201 and 301, indoor fans 202 and 302, opening-regulatable indoor expansion valves (indoor expansion mechanisms) 203 and 303 formed with an electronic expansion valve or the like, sucked-air temperature sensors 206 and 306, blown-air temperature sensors 207 and 307, and the like.

Next, the operation will be described. Upon cooling operation, the refrigerant flows as indicated with a solid arrow. That is, in the high-temperature and high-pressure gas refrigerant discharged from the compressor 104, refrigerating machine oil is separated with the oil separator 106, and the high-temperature gas refrigerant is sent through the four-way valve 108 to the outdoor heat exchanger 101. The refrigerating machine oil separated with the oil separator 106 is sent through the oil return capillary 107 to the accumulator 105. In the outdoor heat exchanger 101, the high-temperature and high-pressure gas refrigerant having entered the outdoor heat exchanger 101 condenses by heat exchange with outdoor air sent with the outdoor fan 102 into liquid refrigerant.

Thereafter, the liquid refrigerant passes through the outdoor expansion valve 103 (fully opened upon cooling operation), then flows through the liquid pipe 121, and is sent to the indoor units 200 and 300. The refrigerant sent to the indoor unit 200 is depressurized with the indoor expansion valve 203, and enters the indoor heat exchanger 201. In the indoor heat exchanger 201, the refrigerant evaporates by heat exchange with indoor air sent with the indoor fan 202, into gas refrigerant. At this time, cold air is sent from the indoor unit 200 into the room and air cooling is performed in the room. The refrigerant sent to the indoor unit 300 changes in the same way as in the case of the indoor unit 200.

The gas refrigerant flowed out of the indoor units 200 and 300 is sent via the gas pipe 122 to the outdoor unit 100. The gas refrigerant, returned to the outdoor unit 100, passes through the four-way valve 108 and enters the accumulator 105. The gas refrigerant having entered the accumulator 105 is sucked, along with the refrigerating machine oil returned from the oil separator 106, from the accumulator 105 into the compressor 104, and is compressed. Thereafter, a similar operation is repeated.

Upon heating operation, the refrigerant flows as indicated with a dotted line arrow. That is, in the high-temperature and high-pressure gas refrigerant discharged from the compressor 104, refrigerating machine oil is separated with the oil separator 106. The high-temperature gas refrigerant from which the refrigerating machine oil is separated is sent through the four-way valve 108 to the gas pipe 122. The refrigerating machine oil separated with the oil separator 106 is sent through the oil return capillary 107 to the accumulator 105.

The high-temperature and high-pressure gas refrigerant having entered the gas pipe 122 is sent to the indoor units 200 and 300. The high-temperature and high-pressure gas refrigerant having entered the indoor unit 200 condenses by heat exchange with indoor air sent with the indoor fan 202 in the indoor heat exchanger 201, into liquid refrigerant.

By the heat exchange between the high temperature refrigerant and the indoor air in the indoor heat exchanger 201, air heating is performed in the room. The liquid refrigerant condensed in the indoor heat exchanger 201 passes through the indoor expansion valve 203, then flows out from the indoor unit 200. The refrigerant sent to the indoor unit 300 changes in the same way as in the case of the indoor unit 200.

Thereafter, the liquid refrigerant having flowed out of the indoor units 200 and 300 is sent through the liquid pipe 121 to the outdoor unit 100. The liquid refrigerant returned to the outdoor unit 100 is depressurized with the outdoor expansion valve 103, then flows into the outdoor heat exchanger 101, and evaporates by heat exchange with outdoor air sent with the outdoor fan 102, into gas refrigerant. The gas refrigerant passes through the four-way valve 108 and enters the accumulator 105. The gas refrigerant having entered the accumulator 105 is sucked, along the refrigerating machine oil returned from the oil separator 106, from the accumulator 105 into the compressor 104, and is compressed. Thereafter, a similar operation is repeated.

The temperature of sucked air (indoor air) in the respective indoor units 200 and 300 is detected with the sucked-air temperature sensors 206 and 306. Further, the temperature of blown air, subjected to heat exchange with the indoor heat exchangers 201 and 301 is detected with the blown-air temperature sensors 207 and 307. Then the difference between the sucked air temperature and the blown air temperature in the respective indoor units 200 and 300 upon cooling operation (hereinbelow, the temperature difference between sucked and blown air) is obtained from the difference between the sucked-air temperature sensors 206 and 306, and the blown-air temperature sensors 207 and 307. The temperature difference between sucked and blown air is obtained with an arithmetic operation part (not shown) of the temperature difference detection device. The arithmetic operation part of the temperature difference detection device is provided in an unshown control unit or the like. That is, the temperature difference detection device comprises the sucked-air temperature sensors 206 and 306, the blown-air temperature sensors 207 and 307, and the arithmetic operation part.

Further, it is possible to estimate the cooling capacity in the respective indoor units 200 and 300 from the temperature difference between sucked and blown air in the respective indoor units 200 and 300 upon cooling operation, obtained with the temperature difference detection device. That is, it can be obtained by multiplying the temperature difference between sucked and blown air with the flow rate of the indoor fans 202 and 302 respectively.

It is possible to perform the cooling capacity control in the respective indoor units 200 and 300 by detecting the temperature difference between sucked and blown air and controlling the indoor expansion valves 203 and 303 so that the temperature difference between sucked and blown air becomes a target value. That is, to increase the cooling capacity, the target value of the temperature difference between sucked and blown air is set at a large value, and the openings of the indoor expansion valves 203 and 303 are increased to obtain the temperature difference closer to the target value. On the other hand, to reduce the cooling capacity, the target value of the temperature difference between sucked and blown air is set at a small value, and the openings of the indoor expansion valves 203 and 303 are reduced to obtain the temperature difference closer to the target value.

With this arrangement, since the cooling capacity is not controlled by the refrigerant superheat degree, the refrigerant at the outlet of the heat exchanger in the indoor units can contain liquid refrigerant. Accordingly, it is possible to suppress rise of the compressor discharge temperature. Further, since the cooling capacity is not controlled by the evaporation temperature control (suction pressure control) either, it is possible to obtain an air conditioner capable of individually controlling the cooling capacity in the respective plurality of indoor units in the multi-room air conditioner.

In the above-described embodiment, as the indoor expansion mechanism, the indoor expansion valve formed with an opening-regulatable electronic expansion valve or the like is used. However, note that the indoor expansion mechanism is not limited to the indoor expansion valve formed with the electronic expansion valve or the like.

That is, an indoor expansion mechanism formed with a plurality of expansion mechanisms having an opening/closing valve and a capillary tube, arrayed in parallel, in which the flow rate is regulated by selectively opening/closing the opening/closing valve, may be used.

Embodiment 2

Figure 2:
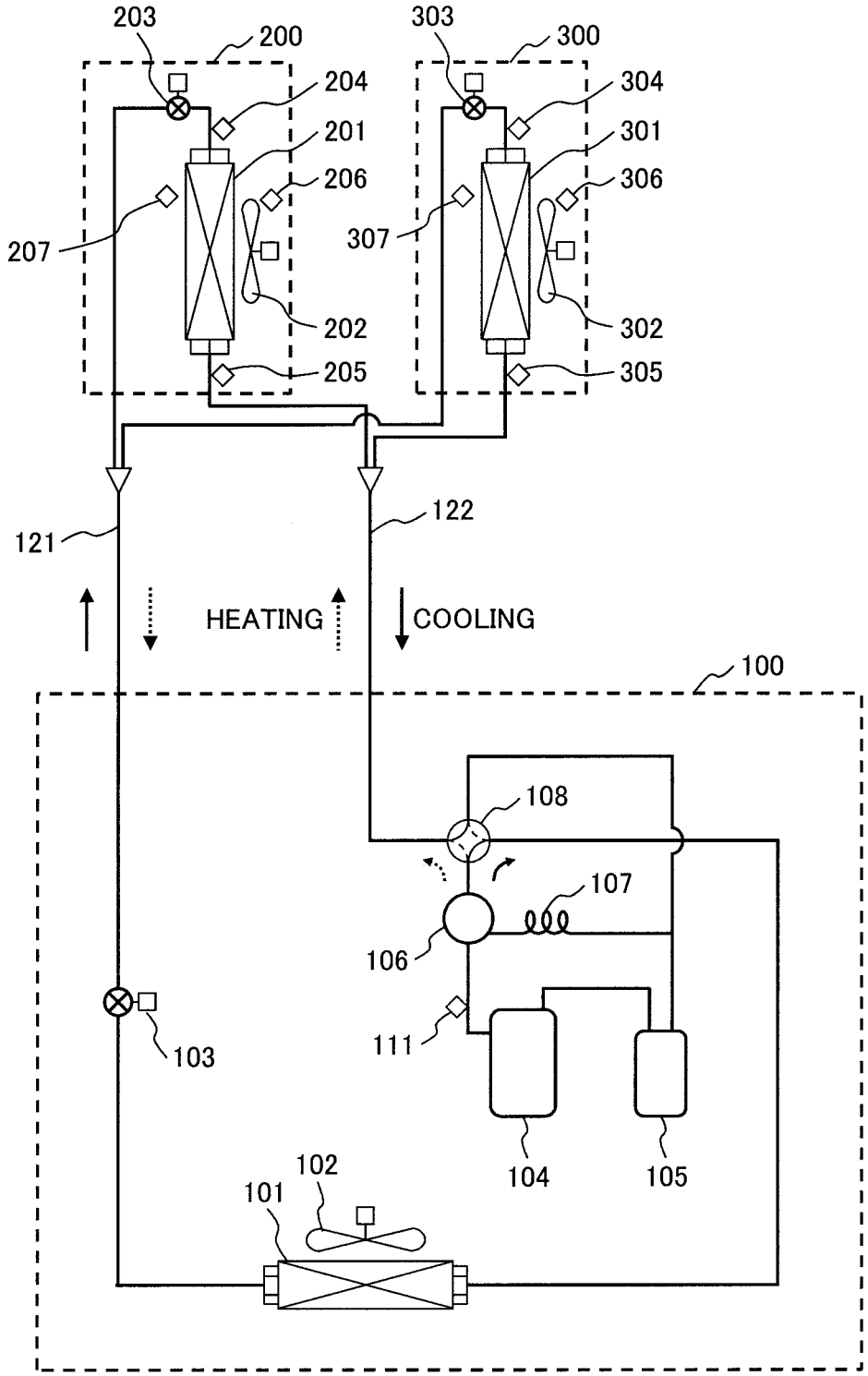
FIG. 2 is a block diagram of a refrigeration cycle showing an embodiment 2 of an air conditioner according to the present invention.
Figure 3:
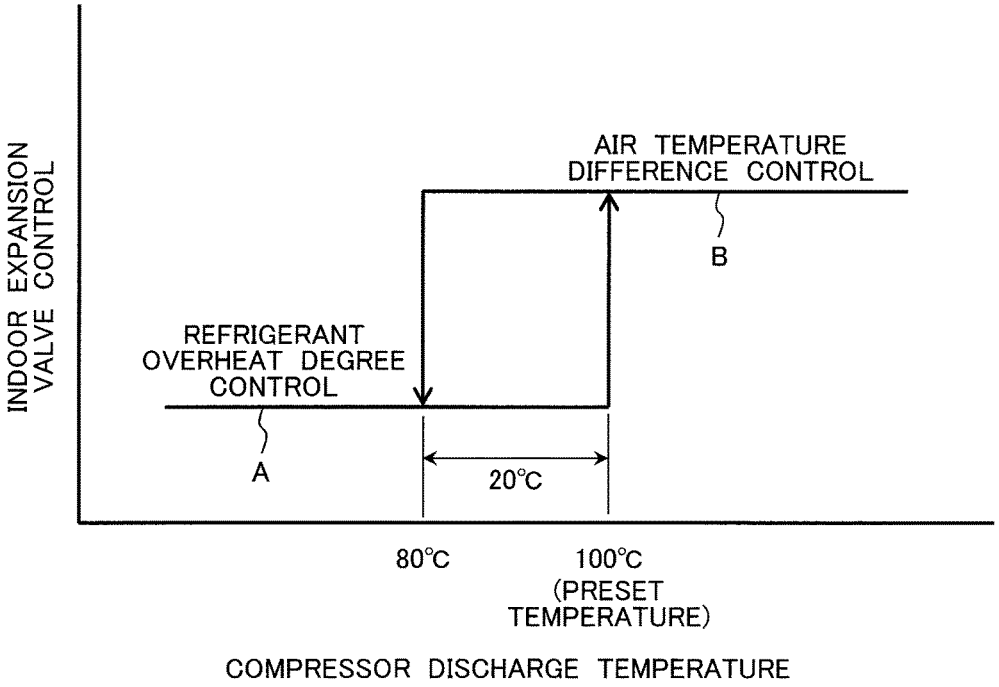
FIG. 3 is a line diagram explaining the operation of indoor expansion valve control upon cooling operation in the embodiment 2 of the present invention.

An embodiment 2 of the air conditioner according to the present invention will be described with reference to FIG. 2 and FIG. 3. FIG. 2 is a block diagram of the refrigeration cycle showing the present embodiment 2, and FIG. 3, a line diagram explaining the operation of the indoor expansion valve control upon cooling operation in the present embodiment 2.

In FIG. 2, the constituent elements having the same reference numerals as those in the above-described FIG. 1 denote identical or corresponding elements. Accordingly, the explanations of the overlapped elements will be omitted.

The outdoor unit 100 has approximately the same configuration as that explained in FIG. 1. In the present embodiment 2, a discharge temperature detection device 111 to detect the discharge temperature of the refrigerant discharged from the compressor 104 is provided in the vicinity of the outlet of the compressor 104 (in a refrigerant pipe connecting the compressor 104 to the oil separator 106 in the present embodiment).

Also the indoor units 200 and 300 basically have approximately the same configurations as those explained in FIG. 1. In the present embodiment 2, in addition to the sucked-air temperature sensors 206 and 306 and the blown-air temperature sensors 207 and 307, described in FIG. 1, refrigerant liquid-side temperature sensors 204 and 304 to detect the temperature of the refrigerant which flows into the indoor heat exchangers 201 and 301 (that is, the temperature of refrigerant between the outlet side of the indoor expansion valves 203 and 303 and the inlet side of the indoor heat exchangers 201 and 301), and refrigerant gas-side temperature sensors 205 and 305 to detect the temperature of the refrigerant which flows from the indoor heat exchangers 201 and 301, are provided.

Note that the discharge temperature detection device 111, the refrigerant liquid-side temperature sensors 204 and 304, and the refrigerant gas-side temperature sensors 205 and 305 may respectively detect the temperature of the refrigerant directly, however, in normal times, they indirectly detect the temperature by measuring the temperature of the refrigerant pipe or the like.

The difference between the temperature of the sucked air and the temperature of the blown air in the respective indoor units 200 and 300 upon cooling operation (temperature difference between sucked and blown air) is obtained with an arithmetic operation part (not shown) of the temperature difference detection device, as a difference between the temperature of the inlet-side air detected with the sucked-air temperature sensors 206 and 306 and the temperature of the outlet-side air detected with the blown-air temperature sensors 207 and 307. Further, it is possible to obtain the refrigerant superheat degree in the respective indoor units 200 and 300 with an arithmetic operation part (not shown) of an superheat degree detection device, from the difference between the refrigerant liquid-side temperature detected with the refrigerant liquid-side temperature sensors 204 and 304 and the refrigerant gas-side temperature detected with the refrigerant gas-side temperature sensors 205 and 305. The respective arithmetic operation parts in the temperature difference detection device and the superheat degree detection device are provided in an unshown control unit or the like. It may be arranged in such a way that one arithmetic operation part is shared as the arithmetic operation part of the temperature difference detection device and as the arithmetic operation part of the superheat degree detection device. That is, as in the case of the embodiment 1, the temperature difference detection device comprises the sucked-air temperature sensors 206 and 306, the blown-air temperature sensors 207 and 307, and the arithmetic operation part. The superheat degree detection device comprises the refrigerant liquid-side temperature sensors 204 and 304, the refrigerant gas-side temperature sensors 205 and 305, and the arithmetic operation part.

The outdoor unit 100 and the indoor units 200 and 300 are connected with each other by the liquid pipe 121 and the gas pipe 122, to form the refrigeration cycle. In the present embodiment, as in the case of the embodiment 1, as refrigerant circulating through the refrigeration cycle, R32 or mixed refrigerant containing 70 mass % or higher percent of R32 is used. In this manner, the air conditioner according to the present embodiment 2 is also formed as a multi-room air conditioner in which the plurality of indoor units 200 and 300 are connected to the one outdoor unit 100.

Note that as the operation upon cooling operation and that upon heating operation in the present embodiment 2 are similar to the operations explained in the above-described embodiment 1, the explanations thereof will be omitted.

Next, the control in the present embodiment 2 will be described.

In the present embodiment, the temperature of the refrigerant discharged from the compressor 104 is detected with the discharge temperature sensor 111 provided in the vicinity of the outlet of the compressor 104. Further, the temperature of the sucked air in the respective indoor units 200 and 300 is detected with the sucked-air temperature sensors 206 and 306, and that of the blown air is detected with the blown-air temperature sensors 207 and 307. The temperature difference between sucked and blown air in the respective indoor units is detected with the temperature difference detection device. Further, the temperature of the refrigerant which flows into the indoor heat exchangers 201 and 301 is detected with the refrigerant liquid-side temperature sensors 204 and 304. The temperature of the refrigerant which flows out of the indoor heat exchangers 201 and 301 is detected with the refrigerant gas-side temperature sensors 205 and 305. The refrigerant superheat degree in the respective indoor units is detected with the superheat degree detection device.

The cooling capacity in the respective indoor units upon cooling operation is controlled in correspondence with the discharge refrigerant temperature of the compressor 104 detected with the discharge temperature sensor 111, by regulating the indoor expansion valves (indoor expansion mechanisms) 203 and 303 based on any one of the air temperature difference detected with the temperature difference detection device and the refrigerant superheat degree detected with the superheat degree detection device in the respective indoor units.

For example, when the discharge temperature detected with the discharge temperature sensor (the discharge temperature detection device) 111 is lower than previously-determined preset temperature, the cooling capacity is controlled by regulating the indoor expansion valve based on the refrigerant superheat degree detected with the superheat degree detection device. When the discharge temperature detected with the discharge temperature sensor 111 is higher than the previously-determined preset temperature, the cooling capacity is controlled by regulating the indoor expansion valves 203 and 303 based on the air temperature difference detected with the temperature difference detection device.

Note that in the present embodiment, it is possible to estimate the cooling capacity in the respective indoor units 200 and 300 by multiplying the temperature difference between sucked and blown air in the respective indoor units 200 and 300 upon cooling operation, obtained with the temperature difference detection device, by the respective flow rates of the indoor fans 202 and 302.

A particular example of the cooling capacity control with the indoor expansion valves 203 and 303 upon cooling operation will be described with reference to FIG. 3. In FIG. 3, the horizontal axis indicates the compressor discharge temperature detected with the discharge temperature sensor 111, and the vertical axis, the cooling capacity control with the indoor expansion valves (indoor expansion mechanisms) 203 and 303.

When the discharge temperature of the compressor is low e.g. immediately after the activation of the compressor 104, as indicated with a straight line A, the cooling capacity control in the respective indoor units 200 and 300 is performed by refrigerant superheat degree control. That is, the refrigerant superheat degree in the respective indoor units 200 and 300 is obtained with the superheat degree detection device from the difference between the refrigerant liquid-side temperature detected with the refrigerant liquid-side temperature sensors 204 and 304 and the refrigerant gas-side temperature detected with the refrigerant gas-side temperature sensors 205 and 305. The cooling capacity control in the respective indoor units 200 and 300 is performed by regulating the openings of the indoor expansion valves 203 and 303 based on the refrigerant superheat degree.

Thereafter, when the discharge temperature of the compressor 104 rises and the discharge temperature of the compressor detected with the discharge temperature sensor 111 becomes a preset temperature (100° C. in this example), the control is switched to air temperature difference control as indicated with a straight line B. That is, the air temperature difference is obtained with the temperature difference detection device from the sucked air temperature detected with the sucked-air temperature sensors 206 and 306, and the blown air temperature detected with the blown-air temperature sensors 207 and 307. The cooling capacity control in the respective indoor units 200 and 300 is performed by regulating the openings of the indoor expansion valves 203 and 303 based on the air temperature difference.

When the cooling capacity control is performed by the air temperature difference control indicated with the straight line B, even though the compressor discharge temperature is lowered to or lower than the preset temperature (100° C. in this example), the control is not immediately switched to the refrigerant superheat degree control. That is, in the present embodiment, after the compressor discharge temperature is lowered to a temperature (80° C. in this example) lower than the preset temperature by previously-determined prescribed temperature (20° C. in this example), then the cooling capacity control is switched from the air temperature difference control indicated with the straight line B to the refrigerant superheat degree control indicated with the straight line A.

Note that as described above, the switching from the refrigerant superheat degree control indicated with the straight line A to the air temperature difference control indicated with the straight line B is performed after the compressor discharge temperature becomes the preset temperature (100° C. in this example). In this manner, in the present embodiment, hysteresis is provided so as to prevent frequent switching between the air temperature difference control and the refrigerant superheat degree control at the preset temperature. Accordingly, it is possible to obtain an air conditioner with higher reliability.

As described above, according to the present embodiment 2, when the compressor discharge temperature becomes equal to or higher than the preset temperature upon cooling operation, control is performed by the air temperature difference control. Accordingly, it is possible to perform control in such a way that the refrigerant at the outlet of the heat exchanger in the indoor unit contains liquid refrigerant. Accordingly, even in an air conditioner using refrigerant such as R32, abnormal rise of the compressor discharge temperature can be suppressed, and therefore it is possible to obtain an air conditioner with high reliability. Further, when control is performed in such a way that the refrigerant at the outlet of the heat exchanger contains liquid refrigerant, it is not possible to use the refrigerant superheat degree control for the cooling capacity control in the respective indoor units. However, in this case, as the cooling capacity in the respective indoor units is controlled by the air temperature difference control, it is possible to individually control the cooling capacity in the respective indoor units of the multi-room air conditioner.

Further, when the compressor discharge temperature becomes equal to or lower than the preset temperature, or lower than the preset temperature by at least a prescribed temperature upon cooling operation, the cooling capacity in the respective indoor units is controlled by the refrigerant superheat degree control. Accordingly, it is possible to perform more accurate control while avoiding abnormal rise of the compressor discharge temperature.

In this manner, according to the above-described respective embodiments of the present invention, in a multi-room air conditioner using R32 as refrigerant, it is possible to obtain an air conditioner capable of suppressing rise of compressor discharge temperature and individually controlling the cooling capacity of a plurality of indoor units respectively.

Note that the present invention is not limited to the above-described embodiments, but includes various modifications.

Further, the above-described embodiments have been described in detail to assist understanding of the present invention, and are not limited to those having all the described constituent elements. Further, a part of the constituent elements of an embodiment may be replaced with those of another embodiment. Further, constituent elements of an embodiment may be added to those of another embodiment. Further, with respect to a part of constituent elements of each embodiment, it is possible to perform addition/deletion/replacement of other constituent elements.

Further, programs, information on preset temperature, prescribed temperature and the like to realize the above-described control may be installed in a memory provided in the control unit, a remote controller or the like of the air conditioner, a recording device such as a hard disk or an SSD (Solid State Drive), or in a recording medium such as an IC card, an SD card or a DVD.

REFERENCE SIGNS LIST

100: outdoor unit, 101: outdoor heat exchanger,
102: outdoor fan, 103: outdoor expansion valve,
104: compressor, 105: accumulator, 106: oil separator,
107: oil return capillary, 108: four-way valve,
111: discharge temperature sensor,
121: liquid pipe, 122: gas pipe,
200, 300: indoor unit,
201, 301: indoor heat exchanger,
202, 302: indoor fan,
203, 303: indoor expansion valve,
204, 304: refrigerant liquid-side temperature sensor,
205, 305: refrigerant gas-side temperature sensor,
206, 306: sucked-air temperature sensor,
207, 307: blown-air temperature sensor.

The invention claimed is:

1. A multi-room air conditioner in which a refrigeration cycle is formed by connecting an outdoor unit having an outdoor heat exchanger to a plurality of indoor units having an indoor heat exchanger and an indoor expansion mechanism using a liquid pipe and a gas pipe, wherein a refrigerant consisting essentially of R32 is used as the refrigerant circulating through the refrigeration cycle, wherein the refrigerant at the outlet of the indoor heat exchanger in each of the indoor units is controlled to contain liquid refrigerant, wherein the air conditioner comprises a temperature difference detection device that detects an air temperature difference between inlet-side air and outlet-side air in respective indoor heat exchangers of the respective indoor units, wherein cooling capacity in the respective indoor units is individually controlled by regulating the indoor expansion mechanism in the respective indoor units to make the air temperature difference closer to a target value in the respective indoor units detected with the temperature difference detection device, wherein the outdoor unit is provided with a compressor, and has a discharge temperature sensor to detect a discharge temperature of the refrigerant discharged from the compressor and an superheat degree detection device to detect a refrigerant superheat degree in the respective indoor heat exchangers, wherein the cooling capacity in the respective indoor units is controlled, in correspondence with the discharge temperature detected with the discharge temperature sensor, by regulating the indoor expansion mechanism based on any one of the air temperature difference detected with the temperature difference detection device of the respective indoor units and the refrigerant superheat degree detected with the superheat degree detection device, wherein when the discharge temperature detected with the discharge temperature detection device is lower than a previously-determined preset temperature, the cooling capacity is controlled by regulating the indoor expansion mechanism based on the refrigerant superheat degree detected with the superheat degree detection device, and wherein when the discharge temperature detected with the discharge temperature detection device is higher than the previously-determined preset temperature, the cooling capacity is controlled by regulating the indoor expansion mechanism based on the air temperature difference detected with the temperature difference detection device.

2. The multi-room air conditioner according to claim 1, wherein the temperature difference detection device that detects the air temperature difference in the respective indoor units has a sucked-air temperature sensor to detect a temperature of inlet-side air of the indoor heat exchanger and a blown-air temperature sensor to detect a temperature of outlet-side air of the indoor heat exchanger, and based on the temperatures detected with these temperature sensors, detects the air temperature difference between the inlet-side air and the outlet-side air of the indoor heat exchanger.

3. A multi-room air conditioner in which a refrigeration cycle is formed by connecting an outdoor unit having an outdoor heat exchanger to a plurality of indoor units having an indoor heat exchanger and an indoor expansion mechanism using a liquid pipe and a gas pipe, wherein as refrigerant circulating through the refrigeration cycle, R32 or mixed refrigerant containing 70 mass % or higher percent of R32 is used, wherein the refrigerant at the outlet of the indoor heat exchanger in each of the indoor units is controlled to contain liquid refrigerant, wherein the air conditioner comprises a temperature difference detection device that detects an air temperature difference between inlet-side air and outlet-side air in respective indoor heat exchangers of the respective indoor units, wherein cooling capacity in the respective indoor units is individually controlled by regulating the indoor expansion mechanism in the respective indoor units to make the air temperature difference closer to a target value in the respective indoor units detected with the temperature difference detection device, wherein the outdoor unit is provided with a compressor, and has a discharge temperature sensor to detect a discharge temperature of the refrigerant discharged from the compressor and an superheat degree detection device to detect a refrigerant superheat degree in the respective indoor heat exchangers, wherein the cooling capacity in the respective indoor units is controlled, in correspondence with the discharge temperature detected with the discharge temperature sensor, by regulating the indoor expansion mechanism based on any one of the air temperature difference detected with the temperature difference detection device of the respective indoor units and the refrigerant superheat degree detected with the superheat degree detection device, wherein when the discharge temperature detected with the discharge temperature detection device is lower than a previously-determined preset temperature, the cooling capacity is controlled by regulating the indoor expansion mechanism based on the refrigerant superheat degree detected with the superheat degree detection device, and wherein when the discharge temperature detected with the discharge temperature detection device is higher than the previously-determined preset temperature, the cooling capacity is controlled by regulating the indoor expansion mechanism based on the air temperature difference detected with the temperature difference detection device.

4. The multi-room air conditioner according to claim 3, wherein when the cooling capacity is controlled by regulating the indoor expansion mechanism based on the air temperature difference detected with the temperature difference detection device, the cooling capacity control is switched to control of regulating the indoor expansion mechanism based on the refrigerant superheat degree detected with the superheat degree detection device, after the discharge temperature detected with the discharge temperature sensor becomes a temperature lower than the preset temperature by a previously-determined prescribed temperature.

* * * * *